US005085456A

United States Patent [19]

Horn

[11] Patent Number: 5,085,456

[45] Date of Patent: Feb. 4, 1992

[54] RELEASE BINDING WITH PLATE

[75] Inventor: Hans Horn, Bern, Switzerland

[73] Assignee: Skis Rossignol S.A., Voiron, France

[21] Appl. No.: 603,472

[22] Filed: Oct. 25, 1990

[30] Foreign Application Priority Data

Nov. 13, 1989 [FR] France ..... 89 14842

[51] Int. Cl.[5] ..... A63C 9/08

[52] U.S. Cl. ..... 280/618

[58] Field of Search ..... 280/613, 618, 607, 617, 280/611

[56] References Cited

U.S. PATENT DOCUMENTS

| | | | |
|---|---|---|---|
| 3,727,932 | 4/1973 | Druss et al. | 280/613 |
| 3,884,489 | 5/1975 | Gertsch et al. | 280/618 |
| 4,294,461 | 10/1981 | Eckart | 280/618 |
| 4,600,213 | 7/1986 | Sedlmair et al. | 280/618 |

FOREIGN PATENT DOCUMENTS

| | | |
|---|---|---|
| 382519 | 3/1987 | Austria . |
| 2851634 | 6/1980 | Fed. Rep. of Germany . |

*Primary Examiner*—Andres Kashnikow
*Assistant Examiner*—Michael Mar
*Attorney, Agent, or Firm*—Kane, Dalsimer, Sullivan, Kurucz, Levy, Eisele & Richard

[57] ABSTRACT

The binding comprises a plate mounted pivotably on a ski about an axis by means of a pivot. The plate is provided with a horizontal finger, which is engaged in a bayonet groove of the pivot, with vertical play, in order to retain the plate axially on its pivot upon bending of the ski. The plate is thus not weakened by a perforation and the pivot is better protected against the formation of ice.

4 Claims, 3 Drawing Sheets

RELEASE BINDING WITH PLATE

FIELD OF THE INVENTION

The present invention relates to a release binding for a ski comprising an underfoot plate mounted pivotably on the ski about a vertical axis.

PRIOR ART

Such bindings are described, for example, in the patents AT 382 519, DE 28 51 634, U.S. Pat. No. 4,294,461 and U.S. Pat. No. 3,884,489. In all these bindings, the plate is retained axially on its pivot by means of a retaining piece screwed from the top of the plate. Such axial retention is necessary even if the plate is retained perpendicularly to the ski in its front part and in its rear part because of the bending of the ski in the area of the binding, bending by means of which the plate could escape from its pivot. The known method of retention not only necessitates an auxiliary piece but above all it weakens the plate in its most stressed zone by creating a hole through the plate. Such a hole moreover makes it possible for snow which is compressed and melted by the boot to penetrate into the pivot where it forms ice. In the case of a plate binding made of two telescopic parts, in which one of the parts of the plate has to be capable of working longitudinally in order to ensure disengagement in a backward fall, as is the case in the binding described in the European patent application No 0 385 944 of the applicant, this ice is capable of preventing the rear part of the plate moving back and consequently of preventing the disengagement of the binding.

A binding is also known, in which the plate does not comprise an axial retaining piece on its central pivot, the lateral retention of the plate being ensured, in principle, by a relatively long pivot, on which the plate can slide axially.

This solution necessitates a relatively very thick plate, which increases the weight of the binding and raises the boot on the ski, reducing the control of the ski.

SUMMARY OF THE INVENTION

The aim of the present invention is to prevent the disadvantages of the known plate bindings, including the binding described in the European patent application No 0 385 944 corresponding to U.S. application Ser. No. 483,457 filed Feb. 21, 1990, now pending.

To this end, the release binding for a ski according to the invention is defined in that the pivotable mounting of the plate on the ski is ensured by two profiled parts, male and female respectively, one of which is integral with the plate and the other integral with the ski, these two profiled parts being assembled with one another in a rotary manner by means of a bayonet device, one of said profiled parts having to this end at least one radial finger and the other profiled part at least one groove having a descending part followed by a part in the form of a circular arc centered on the pivoting axis and of such a length that it permits the rotation of the plate necessary for the disengagement of the binding.

This method of mounting the plate on its pivot does not necessitate auxiliary pieces or an opening through the plate. The plate is thus not weakened in its central part and the absence of an opening prevents snow penetrating into the pivot under the pressure of the boot.

The male piece can be integral with the ski and the female piece with the plate or vice versa. Similarly, the bayonet groove can be formed on the part which is integral with the plate, male or female, or on the part which is integral with the ski, male or female. As far as the part descending from the bayonet groove is concerned, it does not necessarily have to be parallel to the pivoting axis, but can be oblique, curved, or even sinuous.

BRIEF DESCRIPTION OF THE DRAWINGS

The attached drawing represents, by way of example, an embodiment of the ski binding according to the invention.

DESCRIPTION OF THE PREFERRED EMBODIMENT

Figure 1:
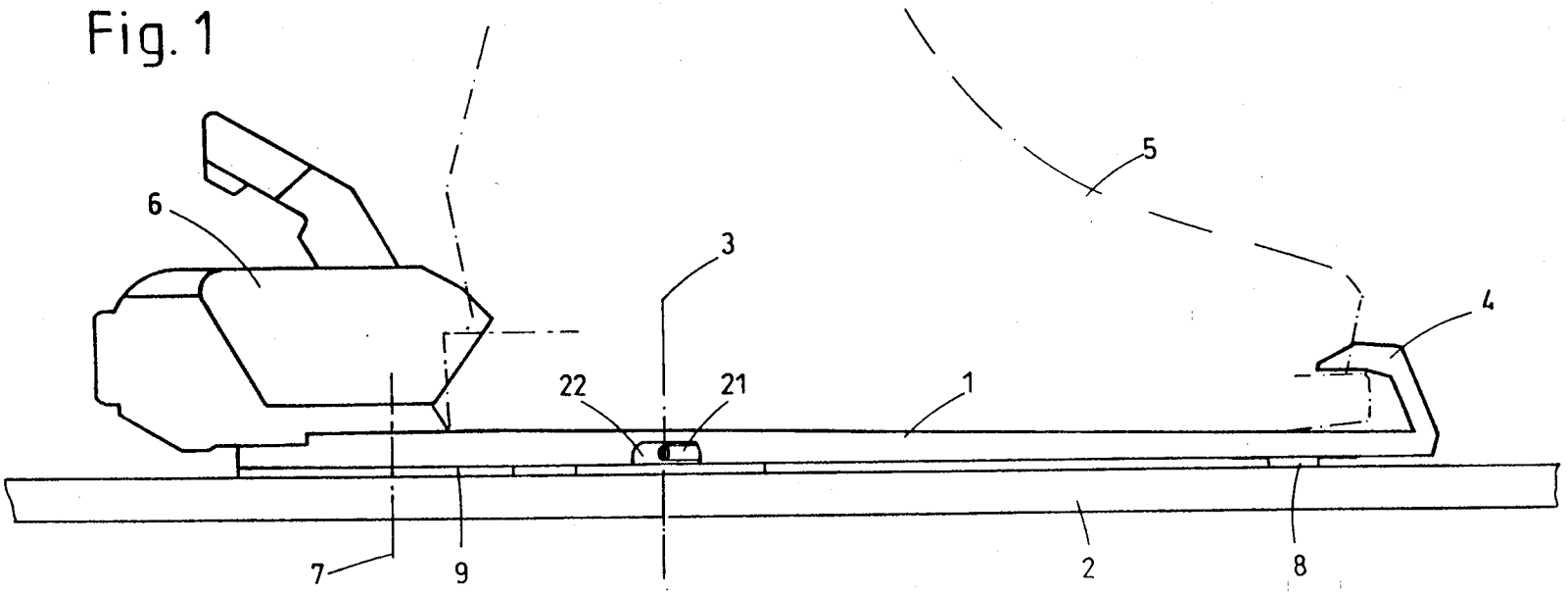
FIG. 1 represents a side view of the binding in closed position.

The binding represented is of the same type as the binding described in the patent application FR 89 02 516 corresponding to U.S. application Ser. No. 482, 539 filed Feb. 21, 1990, now U.S. Pat. No. 5,040,819. It comprises essentially a plate 1 mounted pivotably on a ski 2 about a vertical axis 3 and provided at the front with a jaw 4 for the retention of the front end of a boot 5 represented in dot-dash lines and, at the rear, with a heel-piece 6 which is mounted pivotably on the plate 1 about a vertical axis 7. This heel-piece is described in detail in the European patent application No 0 385 944 of the applicant. The plate 1 is moreover supported at the front and at the rear by means of support and of guidance 8 and 9 such as are described and represented in the European patent application No 0 385 944 corresponding to U.S. application Ser. No. 483,457 filed Feb. 21, 1990, now pending.

Figure 2:
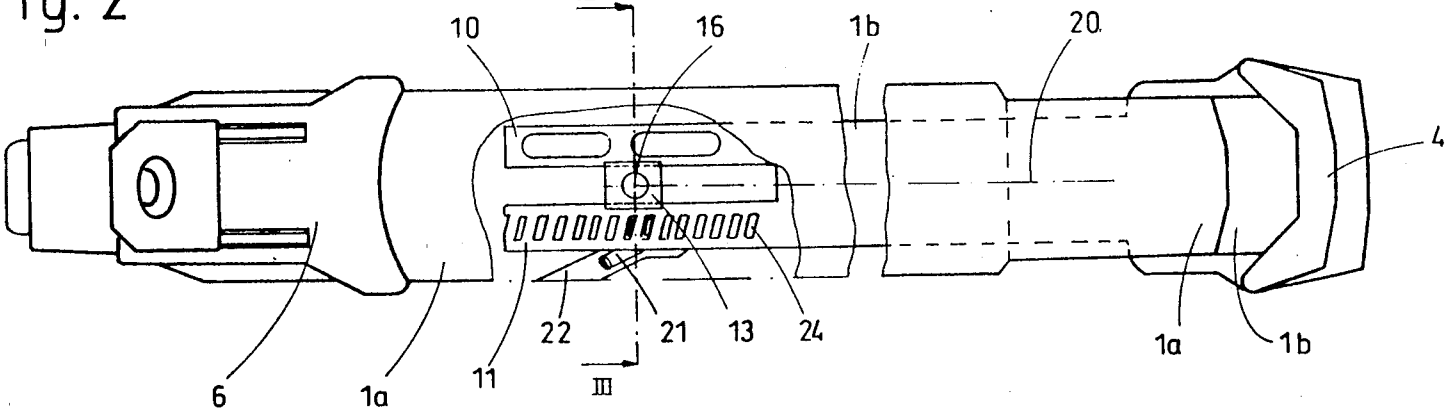
FIG. 2 is a view from above of this binding with a cutaway of the plate allowing the pivot to be seen.
Figure 3:
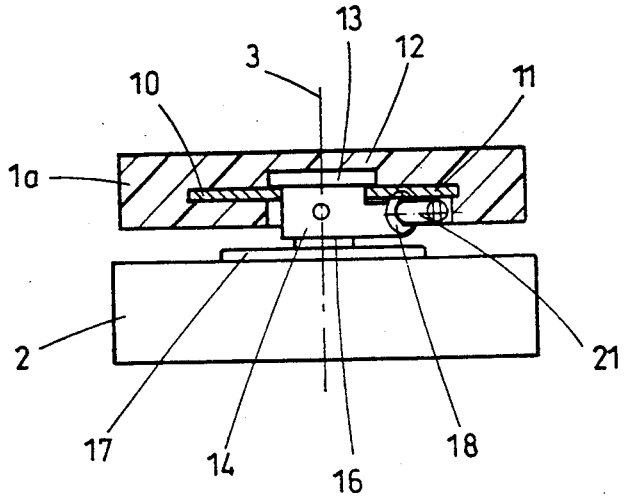
FIG. 3 is a cross-sectional view according to III—III in FIG. 2.
Figure 4:
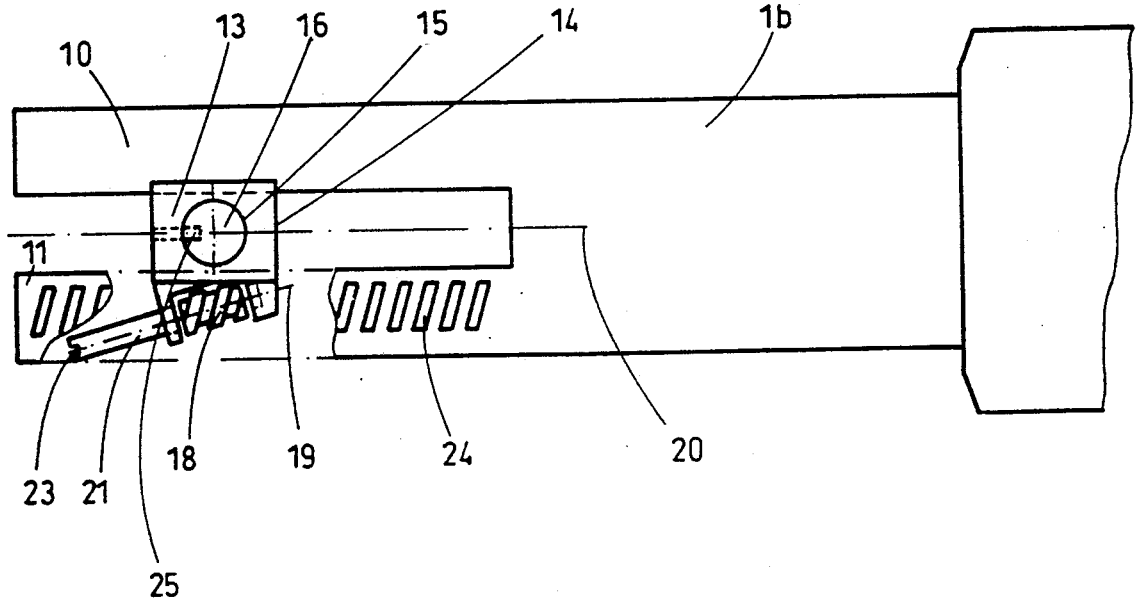
FIG. 4 is a detail of FIG. 2.

As in the abovementioned patent application, the plate 1 consists of two telescopic parts, namely a rear part 1*a* bearing the heel-piece 6 and a front part 1*b* formed in one piece with the front jaw 4 and mounted slidably on the inside of the rear part 1*a*. That part of the front part 1*b* of the plate which is opposite the jaw 4 has two parallel rectangular arms 10 and 11 which slide in the part 1*a*, as can be seen from FIG. 3. In this same figure, it can be seen that the part 1*a* has a rectangular groove 12, the width of which is greater than the distance between the arms 10 and 11, so that the groove 12 and the arms 10 and 11 form a sort of runner, in which is retained the rectangular flange 13 of a member 14 which is provided with a vertical cylindrical bore 15 (FIG. 2), in which a pivot 16 engages, which is integral with a collar 17 which is fixed to the ski 2. The member 14 also serves as support for an endless screw 18, the axis 19 of which, which is parallel to the ski, forms an angle of 25° with the axis 20 of the plate 1. The endless screw 18 is extended by a smooth cylindrical part 21 which extends in a passage 22 which is arranged in the part 1*a* of the plate and opens laterally on the side of the plate. The end of the part 21 is provided with a screw slot 23 which permits the actuation of the endless screw by means of a screwdriver. The endless screw 18 is in engagement, from underneath, with a rack 24 which consists of slots which are parallel to one another and slightly oblique in relation to the axis 20 of the plate. The slots of the rack 24 are moreover tangent to the helix of the endless screw 18. The setting in rotation of the endless screw 18 has the effect of displacing the part 1*b* of the plate in relation to the pivot 16.

In the case of a binding for disengagement in a backward fall such as is described in the European patent application No 0 385 944 corresponding to U.S. application Ser. No. 483, 457 filed Feb. 21, 1990, now pending, the part 1*a* of the plate is, in the absence of a boot, pushed by the spring of the safety mechanism against a stop mounted at the rear and this part 1*a* must be capable of being displaced towards the rear. In this case, the length of the groove 12 must be greater than the length of the flange 13 in order to permit this backward movement. In contrast, in the case of a plate binding without disengagement, in a backward fall, by means of backward movement of the rear part of the plate, the groove 12 can have the form of a housing of the same dimensions as the flange 13.

The member 14 is provided with a radial finger 25 which projects on the inside of the bore 15. This finger 25, which here consists of a pin, serves to lock the member 14 axially on the pivot 16 by means of a bayonettype engagement.

Figure 5:
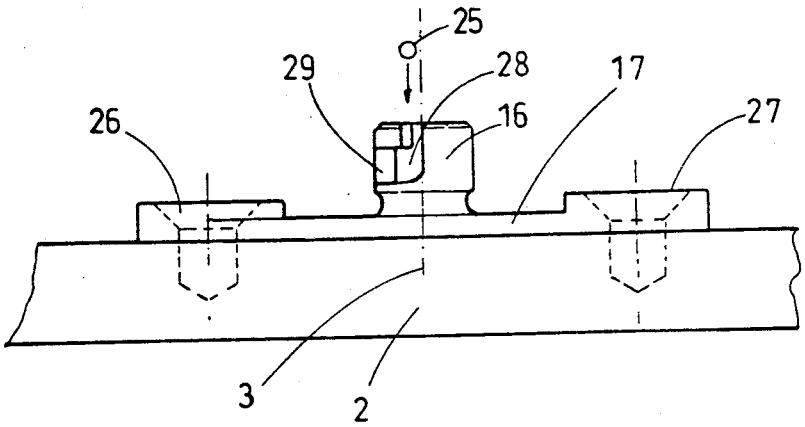
FIG. 5 is a lateral view of the pivot without its plate.
Figure 6:
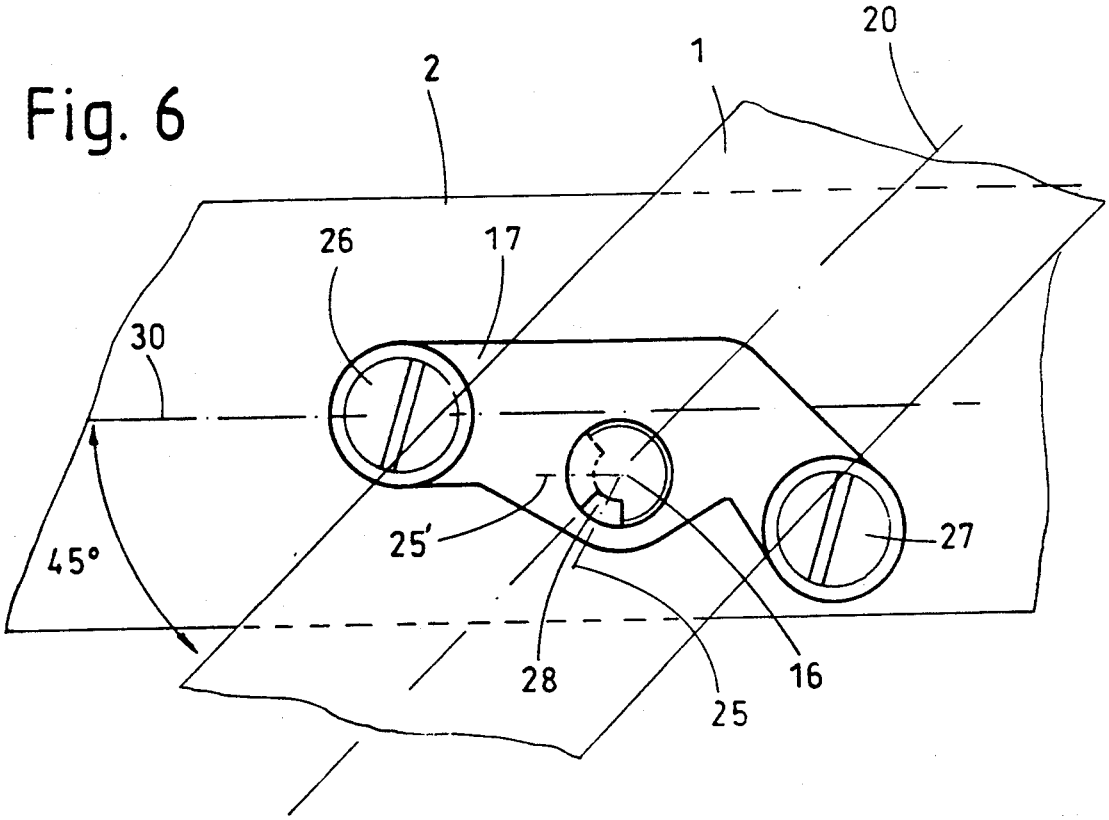
FIG. 6 is a view from above of this pivot also showing the position of the plate for its mounting on the pivot.

The plate 17 bearing the pivot 16 is fixed to the ski 2 by means of two screws 26 and 27 (FIGS. 5 and 6). The pivot 16, in this case a solid cylindrical male part, is provided with a bayonet groove which has a descending part 28 which is parallel to the pivoting axis, open at the upper part of the pivot 16 and opens into a second part 29 in the form of a circular arc which is centered on the pivoting axis 3 and the width of which is substantially greater than the diameter of the finger 25.

To mount the plate 1 on its pivot, it is positioned obliquely in relation to the ski, so that its axis 20 forms an angle of 45° with the axis 30 of the ski. In this position, the finger 25 is situated opposite the entrance of the groove 28. In FIG. 6, this finger is represented simply by its axis. It is then necessary only to engage the finger 25 vertically in the part 28 of the groove, then to bring the axis 20 of the plate parallel to the axis 30 of the ski. The plate is then locked vertically according to the direction of the axis 3. In this position 25', the finger 25 can carry out an angular displacement on both sides of this position, this displacement being sufficient to permit the disengagement of the binding when twisting, without the plate for all that being capable of escaping from its pivot. The vertical play of the finger 25 in the groove 29 is moreover sufficient to permit the bending of the ski in the area of the binding.

As has already been mentioned in the introduction, this design is capable of numerous alternative embodiments. In particular, the bayonet groove could be provided on the piece 14 which is integral with the plate, the finger 25 then consisting of a pin driven into the pivot 16. The cylindrical male part could be integral with the plate, the piece which is integral with the ski then being a female piece having a cylindrical bore. The male or female part could be formed in one piece with the part 1*a* of the plate. In this case, the bayonet groove is preferably provided on this piece. If the structure of the ski allows, the female piece which is integral with the ski could consist of a hollow in the ski.

If there is sufficient subsisting material, it would also be possible to provide two bayonet grooves and two fingers. The finger could be machined and have a square or other cross-section.

What is claimed is:

1. A release binding for a ski comprising an underfoot plate (1) mounted pivotably on the ski (2) about a vertical axis (3), wherein the pivotable mounting of the plate on the ski is ensured by two profiled parts, male and female (14, 16) respectively, one (14) of which is integral with the plate and the other (16) integral with the ski, these two profiled parts being assembled with one another in a rotary manner by means of a bayonet device, one of said profiled parts having to this end at least one radial finger (25) and the other profiled part at least one groove having a descending portion (28) with an opening formed at an upper end of said descending portion and a portion in the form of a circular arc (29) connected to a lower end of said descending portion, said circular arc portion being centered on the pivoting axis and being of such a length so as to permit the rotation of the plate necessary for the disengagement of the binding while preventing disengagement of the plate from said ski.

2. The ski binding as claimed in claim 1, wherein the profiled part which is integral with the plate is formed in one piece with the plate.

3. The ski binding as claimed in claim 1, wherein the profiled part which is integral with the plate consists of an added piece.

4. The ski binding as claimed in claim 3, wherein the plate consists of two telescopic parts, a first one (1*a*) of the telescopic parts of the plate has, on its lower surface, an axial groove (12) and a second one of the telescopic parts (1*b*) has two parallel arms (10, 11) which are engaged in the first telescopic part, on each side of said groove, said parallel arms having portions projecting into this groove, and wherein the added piece (14) which constitutes said profiled part which is integral with the plate is provided with a flange (13) which has two sides parallel to the groove, said flange being fitted into the groove and being retained in this groove by the projecting portion of said arms.

* * * * *